US006354425B1

(12) United States Patent
Tuxen et al.

(10) Patent No.: US 6,354,425 B1
(45) Date of Patent: Mar. 12, 2002

(54) HOUSING FOR PARKING METER

(75) Inventors: Gorm Tuxen, Ridgedale, MO (US); Todd Magness, Harrison, AR (US); Lawrence Berman, Delray Beach, FL (US)

(73) Assignee: Duncan Industries, Harrison, AR (US)

( * ) Notice: Subject to any disclaimer, the term of this patent is extended or adjusted under 35 U.S.C. 154(b) by 2 days.

(21) Appl. No.: 09/599,228

(22) Filed: Jun. 22, 2000

(51) Int. Cl.[7] ..... G07F 9/10
(52) U.S. Cl. ..... 194/350; 403/4
(58) Field of Search ..... 194/350, 900; 403/1, 4, 25, 46, 187, 192, 194, 300, 309

(56) References Cited

U.S. PATENT DOCUMENTS

| | | | | | |
|---|---|---|---|---|---|
| 2,251,407 | A | * | 8/1941 | Johns | 194/9 |
| 2,304,012 | A | * | 12/1942 | Neff | 194/72 |
| 2,323,402 | A | * | 7/1943 | Jones | 194/1 |
| 2,570,920 | A | * | 10/1951 | Clough et al. | 232/16 |
| 2,618,371 | A | * | 11/1952 | Broussard | 194/84 |
| 3,565,283 | A | | 2/1971 | Sciacero et al. | 221/197 |
| 3,708,049 | A | | 1/1973 | Weber | 194/84 |
| 3,782,142 | A | | 1/1974 | Wimpffen | 70/170 |
| 3,782,519 | A | | 1/1974 | Zajac | 194/83 |
| 3,897,864 | A | | 8/1975 | Sciacero et al. | 194/74 |
| 3,913,718 | A | | 10/1975 | Zajac | 194/72 |
| 3,964,590 | A | | 6/1976 | May et al. | 194/83 |
| 4,031,991 | A | | 6/1977 | Malott | 194/1 R |
| 4,798,273 | A | * | 1/1989 | Ward, II | 194/350 |
| 4,986,406 | A | * | 1/1991 | Winsor | 194/350 |
| 5,841,369 | A | | 11/1998 | Sutton et al. | 34/932.2 |

* cited by examiner

*Primary Examiner*—Donald P. Walsh
*Assistant Examiner*—Mark J. Beauchaine
(74) *Attorney, Agent, or Firm*—Piper Marbury Rudnick & Wolfe

(57) ABSTRACT

A parking meter consisting of a housing and a stanchion located adjacent a parking space for mounting of the parking meter thereon. The stanchion has a tubular upper end portion and the parking meter has a tubular lower end portion for positioning around the upper end of the stanchion. A fitting is attached to the upper end of the stanchion and gear teeth are defined by the fitting. The lower end of the meter housing has formed therein a set of gear teeth adapted to mesh with the gear teeth of the fitting in any one of several available relative positions. A bolt and pin combination is employed for providing a high security connection of the fitting and upper housing to the stanchion. Passages are provided so that rainwater and the like is directed outside of the housing and stanchion and does not accumulate within the meter housing.

15 Claims, 3 Drawing Sheets

FIG. 4
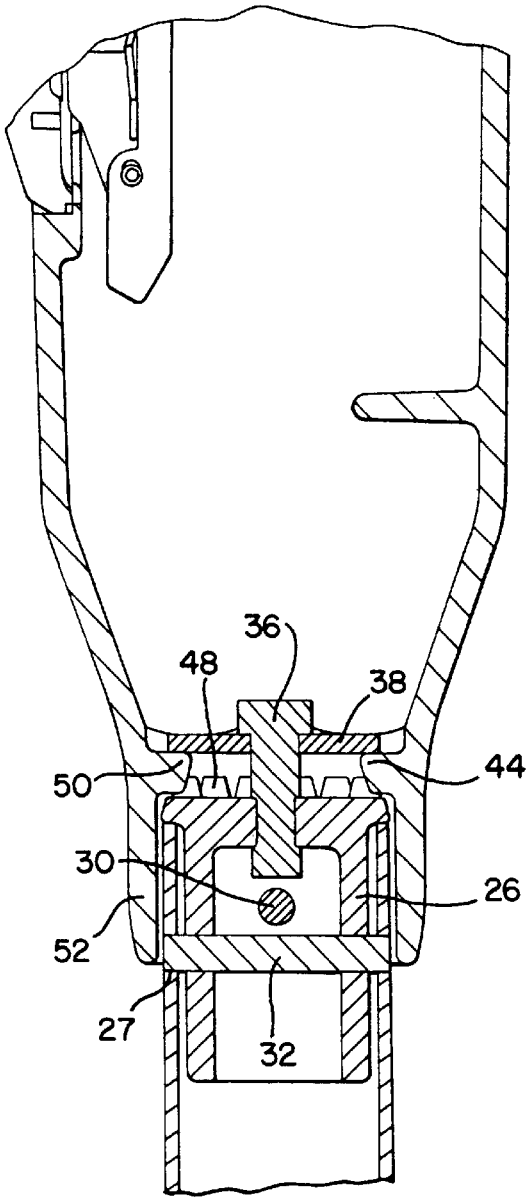
FIG. 5
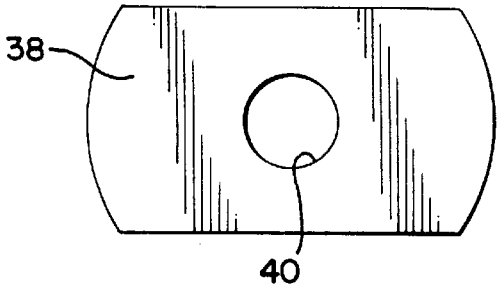
FIG. 6
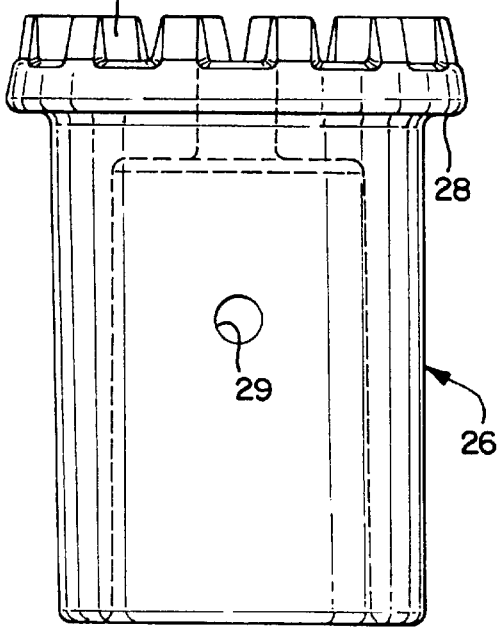
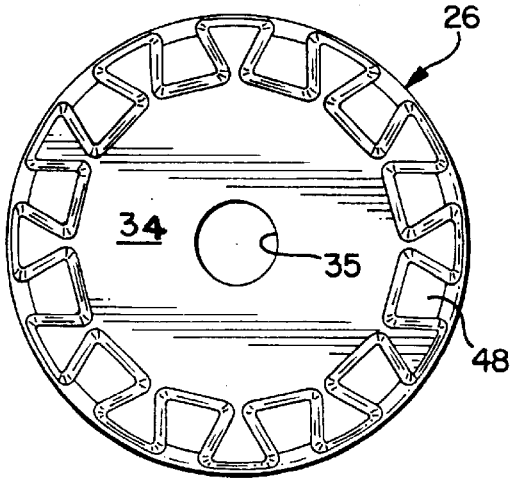
FIG. 7

HOUSING FOR PARKING METER

BACKGROUND OF THE INVENTION

This invention relates to a parking meter and, in particular to an improved design for the parking meter housing.

A typical parking meter is mounted on a metal stanchion or post which is, in turn, located on a street or parking lot in proximity to on or more parking spaces. The parking meter consists of a housing which will typically have an upper housing portion which is used for enclosing a parking meter mechanism and which will include means for accepting payment, recording the time purchased and displaying the parking time remaining.

Particularly because the payment method often includes negotiable coins and tokens, it is necessary to provide security for minimizing break-ins and to also minimize the possibility of that the housing could be separated from the stanchion and stolen. High security locks, cast iron housings and high security coin boxes are among the proposals for achieving this end. Nevertheless, there is a continuing need for improvements in this area.

Independent of this need, it is desirable to provide a meter housing which permits adequate visibility for the parker and for law enforcement officers. Often in a desire to enhance the security of the meter the visibility can be sacrificed, for example, where the design of the means for attachment of the meter housing to a stanchion restricts the manner in which the meter can be positioned relative to a parking space.

Also independent of the need for security, there is a desire to protect coin boxes and other meter parts from the elements, for example water which could enter the housing during a rainstorm. Drainage openings can be provided for this purpose but this can result in more opportunity for prying the housing off of the stanchion and this results in a compromise of the security features of the meter.

SUMMARY OF THE INVENTION

In accordance with this invention, a meter housing design has been designed which greatly improves the security of the meter. In particular, the meter housing is adapted to be mounted on a stanchion in a manner which provides a very high degree of resistance to removal by unauthorized persons. The mounting means comprises a tubular lower end of the housing which serves as a shield positioned around a tubular upper end of the stanchion. A fitting is positioned within the stanchion and diametrically aligned openings, preferably two aligned pairs offset by 90 degrees, are provided in each of the fitting and stanchion upper end with high strength pins are located in the openings to secure the respective components.

The lower end of the housing is attached to the fitting by means of a washer and bolt combination with the bolt extending down into the stanchion. The connection of the upper housing is also achieved by means of gear teeth formed in the upper end of the fitting and in the lower end of the housing. The complementary gear teeth secure the housing against twisting relative to the stanchion for added security. In addition, this feature permits the location of the housing at a variety of angles relative to the stanchion. Accordingly, the meter accommodates various configurations of parking spaces and permits maximum versatility with respect to convenience for viewing by both the driver of the vehicle using the space and law enforcement personnel.

In addition to the security and versatility referred to, the described arrangement provides for protection against the accumulation of water from rainfall or the like within the housing. Thus, the washer and bolt arrangement and the housing interface with the stanchion allows for drainage from within the housing to the exterior of the stanchion without compromising the secure attachment of the housing to the meter.

DESCRIPTION OF THE DRAWING FIGURES

FIG. 4 is an enlarged sectional view illustrating the attachment of the housing and stanchion from a position at right angles to the view of FIG. 3;

FIG. 5 is a plan view of the washer construction used in the invention;

FIG. 6 is a side elevational view of the fitting used in the construction;

FIG. 7 is a plan view of the fitting shown in FIG. 6;

DESCRIPTION OF THE PREFERRED EMBODIMENTS

Figure 1:
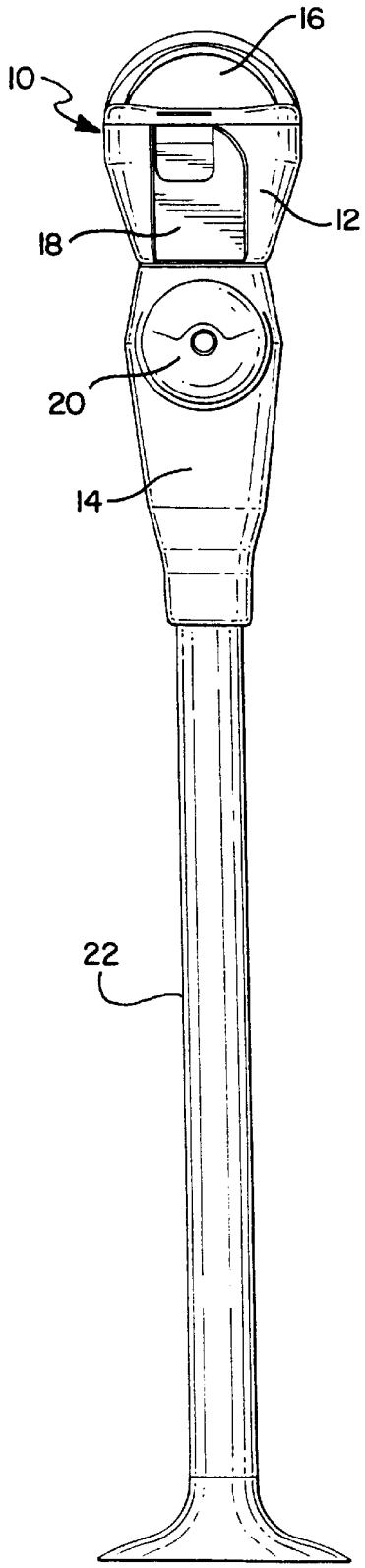
FIG. 1 is an elevational view of the meter housing of the invention.
Figure 2:
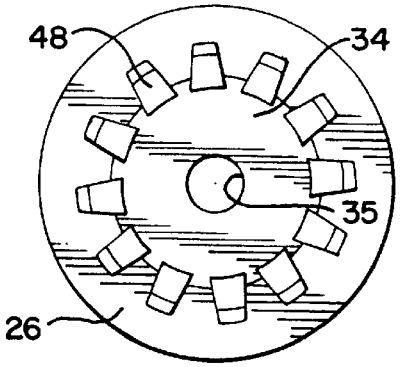
FIG. 2 is a plan view of the fitting used for attaching the housing to the associated stanchion.

FIG. 1 illustrates a parking meter construction 10 comprising upper housing 12 and lower housing 14. The upper housing normally holds a mechanism (not shown) which may be either mechanical or electronic and which is adapted to display time through window 16. Suitable means will be located in the area 18 on one face of the upper housing for receiving coins, a debit card, or other payment means for purchasing of the parking time.

The lower housing includes high security door 20 which will permit access to a box for holding coins and tokens deposited in the meter. The assembly of the upper and lower housings is mounted on a stanchion 22 which will be located on the sidewalk adjacent a street parking location or in some other area such as a parking lot or garage.

FIGS. 2–9 illustrate the details of means employed for assembling the parking meter construction 10 relative to stanchion 22. To achieve this, use is made of a hollow upper tubular section 24 defined by the stanchion and, of course, the entire stanchion may be formed of such a tubular structure. The tubular section supports a tubular fitting 26 which defines an upper rim 28 engaged with the top edge of the tubular section. At least one, and preferably both of a pair of pins 30 and 32 serve to secure the fitting to the stanchion. Each pin extends through diametrically opposite holes 27 defined by the stanchion and corresponding diametrically opposite holes 29 defined by the fitting and aligned with the stanchion holes. As illustrated, the pins are preferably located perpendicular to each other and in vertically spaced relationship.

Figure 8:
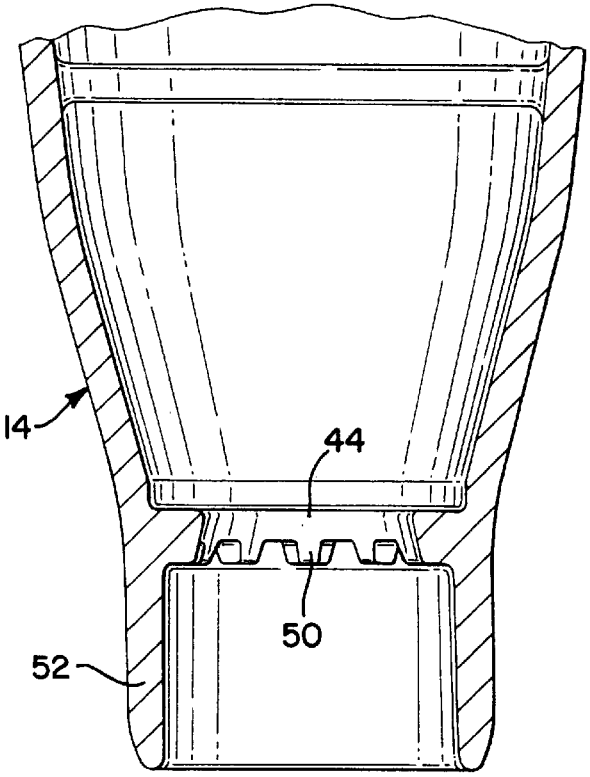
FIG. 8 is detailed fragmentary view illustrating the housing with associated gear teeth.

The fitting 26 has a top wall 34 defining a central opening 35 which receives bolt 36 with this bolt serving as the means for attaching the lower housing 14 to the fitting 26. A washer 38 defines central opening 40 for receiving the bolt and the head 42 of the bolt is supported by this washer. The washer, in turn, rests on the top surfaces of a ledge 44 which is formed adjacent the bottom end of the lower housing as is best shown in FIG. 8.

As shown in FIG. 5, the washer is of generally rectangular shape so that only the long dimension thereof spans the opening defined between diametrically opposed portions of the ledge 44. This leaves passages between the interior of housing 14 and the lower end of the housing so that any rainwater of the like accumulating within the housing interior will flow through and around the fitting 26. As shown by the lines 46, the water will follow a path to the exterior of the stanchion and, therefore, there will be no harmful accumulation of water within the assembly of components.

Figure 9:
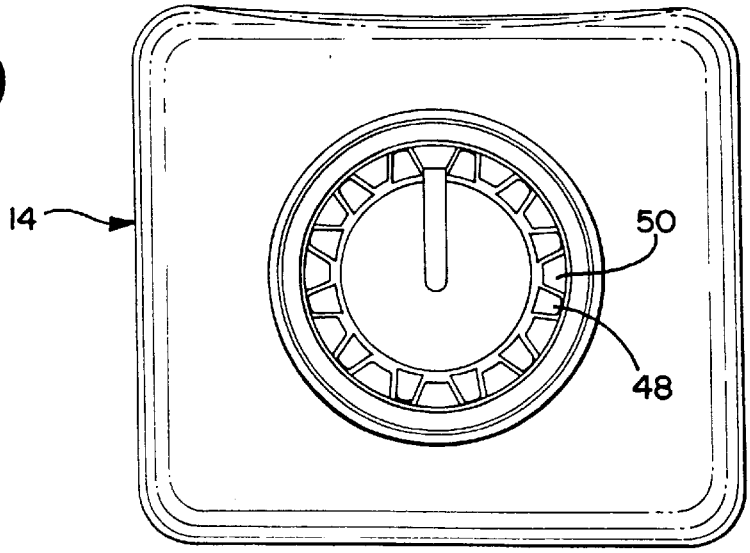
FIG. 9 is a bottom plan view of the housing as shown in FIG. 8.

As best shown in FIGS. 6 and 7, the top surface of the fitting 26 defines gear teeth 48 around its periphery. A meshing set of gear teeth 50 are formed on the underside of the ledge 44 as is best illustrated in FIGS. 8 and 9. In the process of mounting the lower housing 14 on the stanchion 22, the teeth 48 and 50 can be located at any one of twelve different positions so that the most convenient attitude for viewing of the meter display can be selected. The number of teeth may, of course, be varied to increase or decrease the number of available mounting options.

Figure 10:
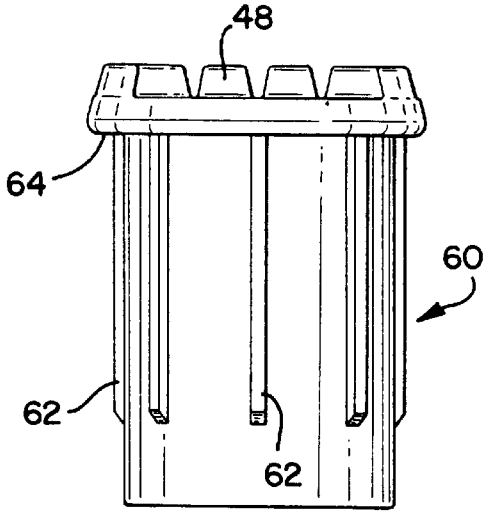
FIG. 10 is a vertical elevational view of an alternative form of fitting usable with this invention.

FIG. 10 illustrates a fitting 60 which can be used as an alternative to the fitting 26. This fitting includes integrally formed vertical splines 62 extending downwardly from upper rim 64. The outer diameter of the fitting, including the splines, exceeds the inner diameter of the stanchion 22 so that an interference fit results when the fitting is inserted into the stanchion. It will be appreciated that other forms of protrusions such as beads could be substituted for the splines 62.

The stanchion will typically be formed of a relative hard steel alloy and the fitting should then be formed of a softer material such as a zinc alloy. This will result in "crushing" of the splines 62 or other type of protrusion to insure a secure assembly. The wall of the fitting 60 may include either or both of the holes 29 to permit the use of pins 30 and/or 32 for securement in addition to that provided by the interference fit.

Figure 3:
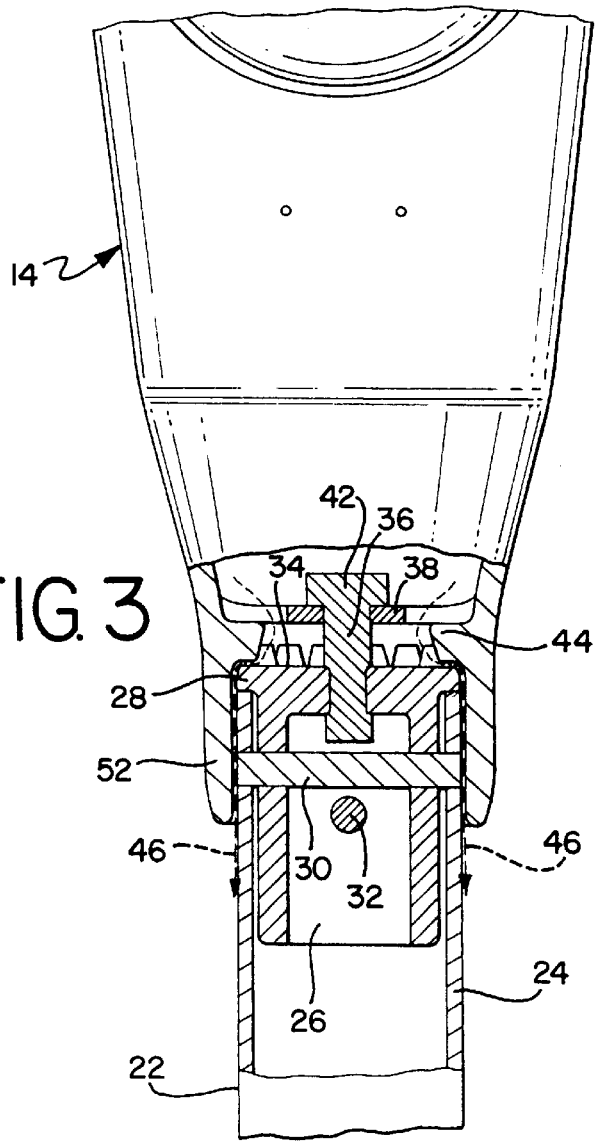
FIG. 3 is an enlarged fragmentary elevational view, partly cut away, illustrating the attachment of the housing and stanchion.

The arrangement described is achieved without compromising the security of the meter. Thus, the housing is very securely attached to the stanchion be means of the bolt 36 and pins 30, 32 and, as best shown in FIGS. 3 and 4, these pins are protected from access by means of the downward tubular extension 52 of the lower housing 14. As best shown if FIG. 1, the walls of the upper and lower housings are tapered upwardly, for example at a 30° angle, which serves to minimize the ability to separate the meter from the stanchion or the housings from each other using a sledge hammer or the like. In addition, even with these security features, there remains the ability to provide passages to insure that rainwater or the like will not accumulate with the meter housings.

It will be understood that various changes and modifications may be made in the subject matter of this invention without departing from the spirit of the invention particularly as set forth in the following claims.

That which is claimed is:

1. A parking meter for mounting on a stanchion positioned adjacent at least one parking space, the parking meter including a housing having means for accepting payment for parking and means for holding payments received, said stanchion having a tubular upper end, said housing having a tubular lower end dimensioned for receiving said upper end of the stanchion, a fitting received within said upper end of the stanchion, gear teeth defined by said fitting, complementary gear teeth defined by said lower end of said housing, and means for securing said upper end and said lower end together with the respective gear teeth in meshing engagement, said upper end being adapted to assume a plurality of different positions relative to the lower end depending on the particular meshing engagement selected.

2. A parking meter according to claim 1 wherein said fitting includes a downwardly depending section, diametrically opposite openings defined by said upper end of the stanchion and at least one aligned opening defined by said downwardly depending section, and a mounting pin extending through said openings for securing the fitting to the stanchion.

3. A parking meter according to claim 2 wherein said fitting defines a separate set of diametrically opposite openings positioned angularly offset relative to the first mentioned diametrically opposite openings, at least one separate opening in said upper end of the stanchion aligned with said separate set of openings, and a second mounting pin extending through said separate set of openings and said one separate opening to further secure the fitting to the stanchion.

4. A parking meter according to claim 3 wherein said downwardly depending section of said fitting is tubular, and wherein the openings in the fitting comprise separate sets of diametrically opposite openings.

5. A parking meter according to claim 2 wherein said lower end of said housing covers access to said mounting pin after the fitting is secured to the stanchion.

6. A parking meter according to claim 1 including a bolt connecting said housing to said fitting.

7. A parking meter according to claim 6 including a shelf defined at the lower end of said housing, and a washer supported on said shelf, said bolt extending through said washer.

8. A parking meter according to claim 7 wherein said complementary gear teeth defined by said lower end extend inwardly, and wherein the top surfaces of the complementary gear teeth form said shelf.

9. A parking meter according to claim 7 wherein said washer is rectangular in shape, the smaller dimension of the washer being such that openings are provided for passage of rain water and the like from the interior of the housing.

10. A parking meter according to claim 9 including an opening defined between said lower end of said housing and said upper end of said stanchion whereby the rain water and the like passes to the exterior of said stanchion.

11. A parking meter according to claim 1 wherein said fitting includes a downwardly depending section, protrusions formed on said downwardly depending section, the lateral dimension of said downwardly depending section, including said protrusions, exceeding the inner lateral dimension of said tubular upper end whereby an interference fit is developed when the fitting is received in said upper end.

12. A parking meter according to claim 11 wherein said protrusions comprise vertically disposed splines.

13. A parking meter according to claim 11 wherein said fitting is formed of a softer material than said stanchion.

14. A parking meter according to claim 11 including diametrically opposite openings defined by said upper end of the stanchion and at least one aligned opening defined by said downwardly depending section, and a mounting pin extending through said openings for securing the fitting to the stanchion.

15. A parking meter according to claim 1 wherein said housing defines side walls tapering upwardly and outwardly relative to said stanchion to minimize the possibility of separating the housing from the stanchion by means of hammer blows or the like.

* * * * *